US007704112B2

(12) United States Patent
Kim

(10) Patent No.: US 7,704,112 B2
(45) Date of Patent: Apr. 27, 2010

(54) PORTABLE PERSONAL SELF-OPERATING LIFE TUBE

(76) Inventor: Yong Tae Kim, Wonmi-gu, Yeokgok-dong 243-33, Seonho Village 203, Puchon, Kyonggido (KR)

( * ) Notice: Subject to any disclaimer, the term of this patent is extended or adjusted under 35 U.S.C. 154(b) by 0 days.

(21) Appl. No.: 12/180,714

(22) Filed: Jul. 28, 2008

(65) Prior Publication Data

US 2009/0061707 A1 Mar. 5, 2009

(51) Int. Cl.
*B63C 9/08* (2006.01)

(52) U.S. Cl. ..... 441/81

(58) Field of Classification Search ..... 441/80, 441/81, 92

See application file for complete search history.

(56) References Cited

U.S. PATENT DOCUMENTS 4,627,822 A * 12/1986 Esposito ..... 441/92
6,004,178 A * 12/1999 Liu et al. ..... 441/96
6,394,867 B1 * 5/2002 Bianco ..... 441/126
6,409,561 B1 * 6/2002 Ibasfalean ..... 441/93
2005/0020155 A1 * 1/2005 Spagnuolo ..... 441/92

* cited by examiner

*Primary Examiner*—Stephen Avila
(74) *Attorney, Agent, or Firm*—Gerald E. Hespos; Anthony J. Casella

(57) ABSTRACT

A portable personal self-operating life tube is disclosed, in which when a user is drowned in water due to a marine disaster or a fire and sinking of a ship, it automatically operates, so the user can save his life by just wearing the tube, and the tube is able to keep a user's a body temperature until a rescue comes after the tube is expanded along with the above features, and a life tube can be easily used without a particular care by improving the problems found in a conventional art in which a user feels bad when wearing a life tube since a conventional life equipment is not customized, and it is not portable and is not easy to use.

6 Claims, 7 Drawing Sheets

PORTABLE PERSONAL SELF-OPERATING LIFE TUBE

BACKGROUND OF THE INVENTION

1. Field of the Invention

The present invention relates to a life tube, and in particular to a portable personal self-operating life tube in which when a user is drowned in water due to a marine disaster or a fire and sinking of a ship, it automatically operates, so the user can save his life by just wearing the tube, and the tube is able to keep a user's a body temperature until a rescue comes after the tube is expanded along with the above features, and a life tube can be easily used without a particular care by improving the problems found in a conventional art in which a user feels bad when wearing a life tube since a conventional life equipment is not customized, and it is not portable and is not easy to use.

2. Description of the Related Art

Generally, a ship is provided with various life equipment such as a life boat, a life tube or a life jacket so as to help an escape or save lives when an emergency situation such as a marine disaster or a defect, fire, sinking or something of a ship.

Among the above life equipments, a lifeboat is a necessary item for escaping from a ship in an emergency situation. With the lifeboat, a lot of people can escape in safe, but a relatively larger size ship might be equipped with the above lifeboat. However, a relatively smaller size ship is generally equipped with a life tube or a life jacket instead.

The above life equipment should be equipped with as many as the number of boarding passenger. It is actually difficult to equip with as many as the number of boarding passenger in a limited space of a ship along with a cost problem.

When the life equipment is not equipped with as many as the number of passenger, when an accident occurs, and the passenger fail to board on a life board, the non-boarded passenger should float on sea while wearing a life tube or a life jacket until a rescue team arrives. Otherwise, the non-boarded passenger might die.

Nobody knows when a marine accident happens. A conventional life tube is not portable, and a conventional life-jacket cannot be worn by a user all the time.

An ordinary person cannot easily wear the conventional life equipment unless he knows a correct use method and wearing method. An ordinary person, who does not have a lot of common senses, cannot use it easily. Even when there is certain life equipment, the equipment might not be used, and a life might lose due to a wrong use method.

The conventional life equipment is generally designed to simply allow a person to float on sea. So, even when a person succeeds in escaping from an accident with a life tube or a life jacket wearing, when a rescue is delayed, the person might die due to a decreasing body temperature by a cold water temperature of sea or might die due to over exhaustion as the person swims hard.

In addition, a conventional life equipment might be exhaled when storing it for a long time, so it is needed to continuously maintain or manage for a quick use of the same in a state that it is stored.

So, it is urgently needed to develop new life equipment which is portable, and is equipped with a function needed for saving lives for a certain time period after escaping from an accident, while overcoming the problems found in the conventional life equipment.

SUMMARY OF THE INVENTION

Accordingly, it is an object of the present invention to provide a portable personal self-operating life tube in which when a user is drowned in water due to a marine disaster or a fire and sinking of a ship, it automatically operates, so the user can save his life by just wearing the tube.

It is another object of the present invention to provide a portable personal self-operating life tube in which the tube is able to keep a user's a body temperature until a rescue comes after the tube is expanded along with the above features.

It is further another object of the present invention to provide a portable personal self-operating life tube in which a life tube can be easily used without a particular care by improving the problems found in a conventional art in which a user feels bad when wearing a life tube since a conventional life equipment is not customized, and it is not portable and is not easy to use.

To achieve the above objects, there is provided a portable personal self-operating life tube which comprises a belt part having an adhesion tape, so its both ends are connected with other; and a tube part which is installed in the belt part, wherein the tube part includes a tube storing room for storing a tube formed of a waterproof clothes; a gas generation module for injecting gas so that the tube is expanded; and a percussion cap for operating the gas generation module, and the belt part and the tube part are engaged with a water soluble polymer.

The tube includes a tube body injected with gas for supporting the tube on the surface of the water; a boarding net formed in a net structure, so a user can ride on a center portion of the tube body; a tube lower part formed in a convex shape in a lower side of the tube body and having a drainage part at its both sides for passing water; and a cover for covering the whole portions of the tube body at both ends of the tube body, and the percussion cap includes a detonation agent; an electric percussion cap for detonating the detonation agent; a circuit part which includes a timer and an amplifier for operating the electric percussion cap; and a seawater battery for supplying electric power to the electric percussion cap and the circuit unit.

The belt part further includes an emergency item such as a rain coat, am emergency food, a light emitting rod, an emergency knife or tool or something, and the belt part is formed in a band shape or a ring shape for being tied to an arm or a leg. The tube part is attached to a life jacket or a clothes instead the belt part.

EFFECTS

According to the portable personal self-operating life tube of the present invention, when a user is drowned in water due to various accidents, fire or sinking of a ship, the tube is automatically expanded, and even when a user loses consciousness, the user can save his life by just wearing the tube.

In addition, a conventional life tube or life clothes is designed to provide a function for floating on water, whereas a portable personal self-operating life tube according to the present invention makes it possible to keep a user's body temperature constant until a rescue team arrives after a tube is expanded by adapting an emergency item provided in a belt part in addition to the operation of a life tube.

The conventional life equipment is not customized to each person, so the user may feel uneasy. In particular, since the volume of a life tube is large sized, it is impossible to equip as many as the number of passenger in a limited space like in a ship, and a person cannot personally equip with the same. The life equipment such as a life clothes can not be easily used since a wearing and use method of the same are not easy, so it is impossible to directly use it in an emergency situation. The conventional life equipment should be periodically maintained and managed, whereas the portable personal self-operating life tube is small sized, which leads to an easier carry and storage and wearing. Since it is automatically expanded upon being drowned in water, it is very easy to use without a particular education and training. Since a sea water battery is used, a maintenance and management are easy since a certain management such as a battery exchange is not needed.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

The portable personal self-operating life tube according to the present invention will be described with reference to the accompanying drawings.

Figure 1:
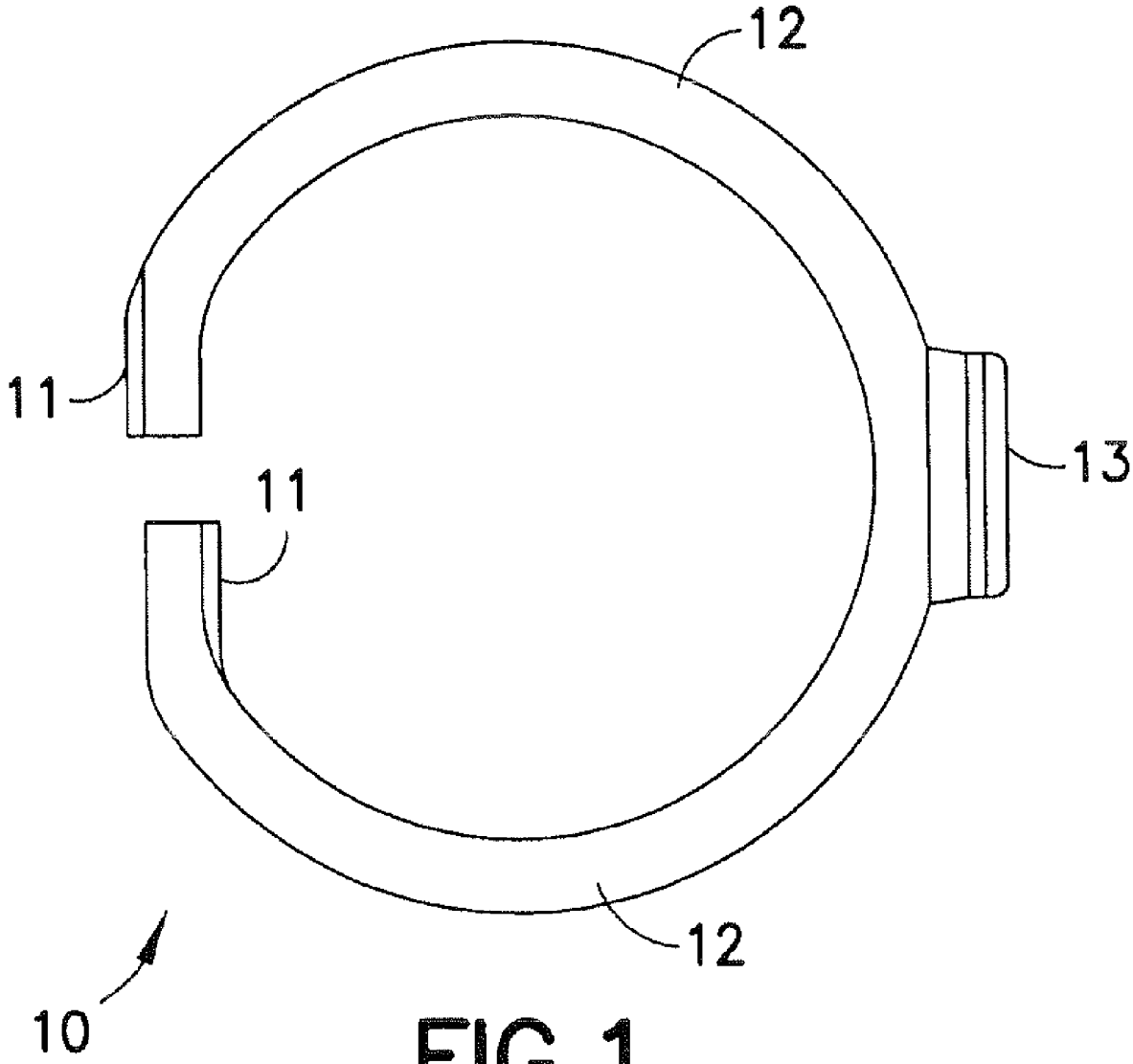
FIG. 1 is a view illustrating a portable personal self-operating life tube according to a first embodiment of the present invention.

FIG. 1 is a view illustrating a portable personal self-operating life tube according to a first embodiment of the present invention.

As shown in FIG. 1, a portable personal self-operating life tube 10 according to a first embodiment of the present invention comprises a belt part 12 and a tube part 13 with an adhesion tape 11 being disposed at both ends of the belt part 12.

The adhesion tape 11 is preferably formed of a Velcro tape for an easier engagement. Here, the adhesion tape 11 is equipped with a substantially strong adhesion strength higher than a common adhesion tape since it is used in water.

So, people can easily wear a portable personal self-operating life tube 10, and the size of the same can be easily adjusted without preparing various size products depending on the body sizes of users like the conventional life jacket or tube.

The belt part 12 is formed of a double structure by using light nylon clothes, and is designed to store or equip with various items such as a rain coat, am emergency food, an emergency knife or tool, a light emitting rod, a water cup or something.

The rain coat is formed of calcium oxide between the double waterproof clothes for self-heating when contacting with water. The water cup is formed of a waterproof clothes and a spring with its bottom side being provided with a mirror.

When in emergency situations, the user can use various items equipped in the belt part 12 for thereby extending a survival period until rescue.

Figure 2:
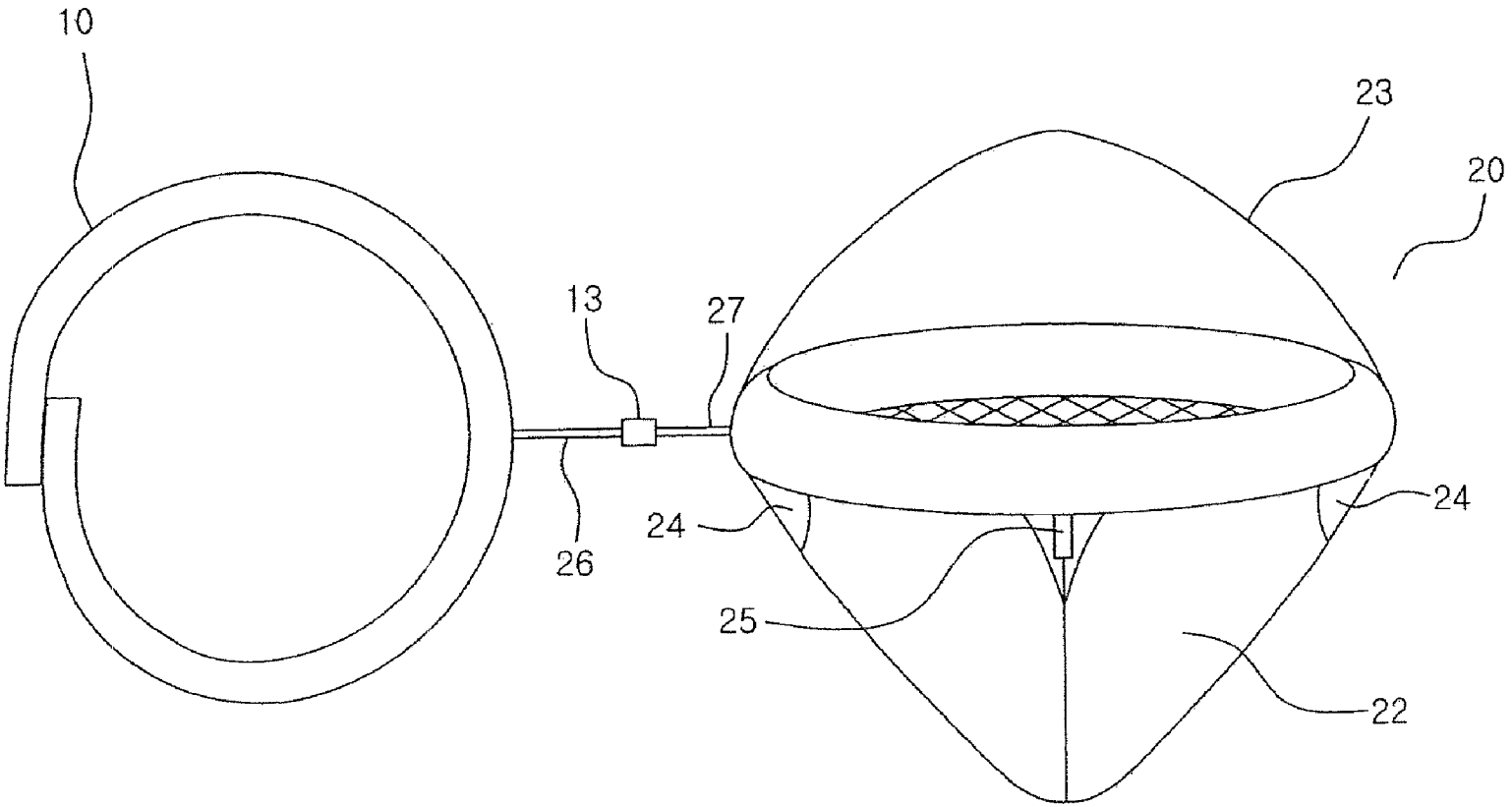
FIG. 2 is a view illustrating an expanded state of a tube in a portable personal self-operating life tube of FIG. 1 according to a first embodiment of the present invention.

When the user is drowned in water with the portable personal self-operating life tube, the tube part 13 starts operating, and the tube is automatically expanded. FIG. 2 is a view illustrating a state that the tube 20 of the portable personal self-operating life tube 10 is expanded.

As shown in FIG. 2, the tube 20 comprises a tube body 21 filled with gas for thereby being floated on water, a tube lower part 22 which is formed in a convex pocket shape in its lower side for receiving and draining water supplied from its upper side while maintaining a balance of the system, and a cover 23 which covers all portions from both sides of the tube body 21. The cover 23 might be supported by a plurality of ribs like the ribs of an umbrella, so a user can pull up from both sides and fix the same. FIG. 2 shows one side of the same.

The tube 20 is formed of a waterproof clothes and is stored in the tube part 13 in a folded state, and its outer side is EVA-coated for preventing the gas from being leaked to the outside, and its inner side is coated with silicon, and the tube lower side 22 is equipped with a plurality of drainage outlets 24 and drainage pipes 25.

Reference numeral 26 represents a connection line for connecting the belt part 12 and the tube part 13, which line is formed of a nylon silk or the like, and reference numeral 27 is formed of a tube made of a waterproof clothes like the drainage pipe 25 for connecting the tube part 13 and the tube 20 and represents a connection pipe 27 which works as a passage when injecting gas.

Figure 3:
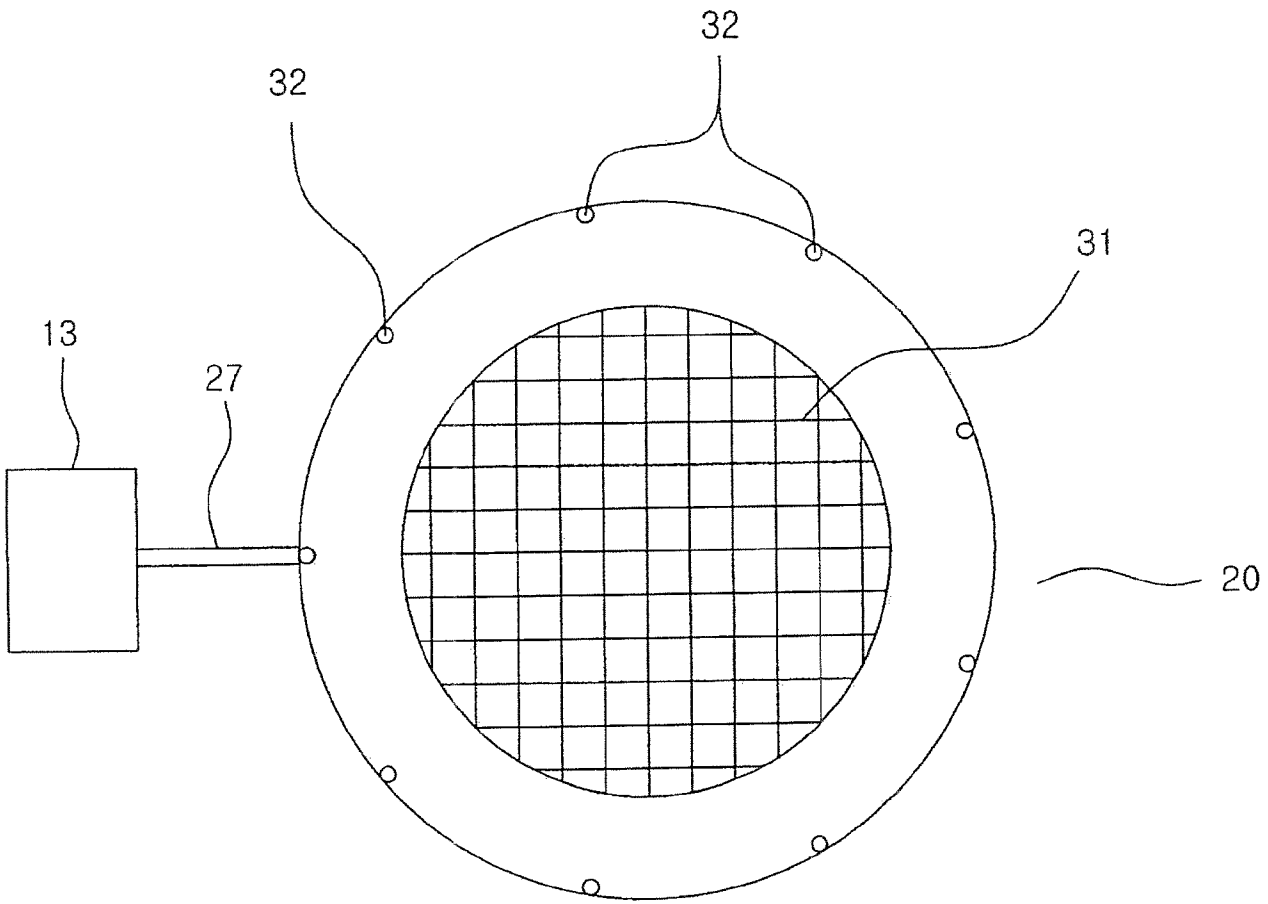
FIG. 3 is a top view illustrating a tube except a cover in a portable personal self-operating life tube of FIG. 2 according to a first embodiment of the present invention.

As shown in FIG. 3, a net shaped boarding net 31 is formed in a center portion of the tube body 21, so a user can ride on the same.

FIG. 3 is a view illustrating a construction when viewing from the tube 20 of FIG. 2 except for the cover 23 of FIG. 3.

As shown in FIG. 3, the boarding net 31 is formed in a net shape or a lattice structure in the center of the tube body 21 by using a waterproof clothes, and the net shaped structure helps an easier drainage of water and works as a handle so a user can easily ride while preventing a reverse flow of water from the lower side. A plurality of light emitting devices like LEDs 32 are installed along an outer surface of the tube body 21, so the location of the user can be easily recognized and detected.

Figure 4:
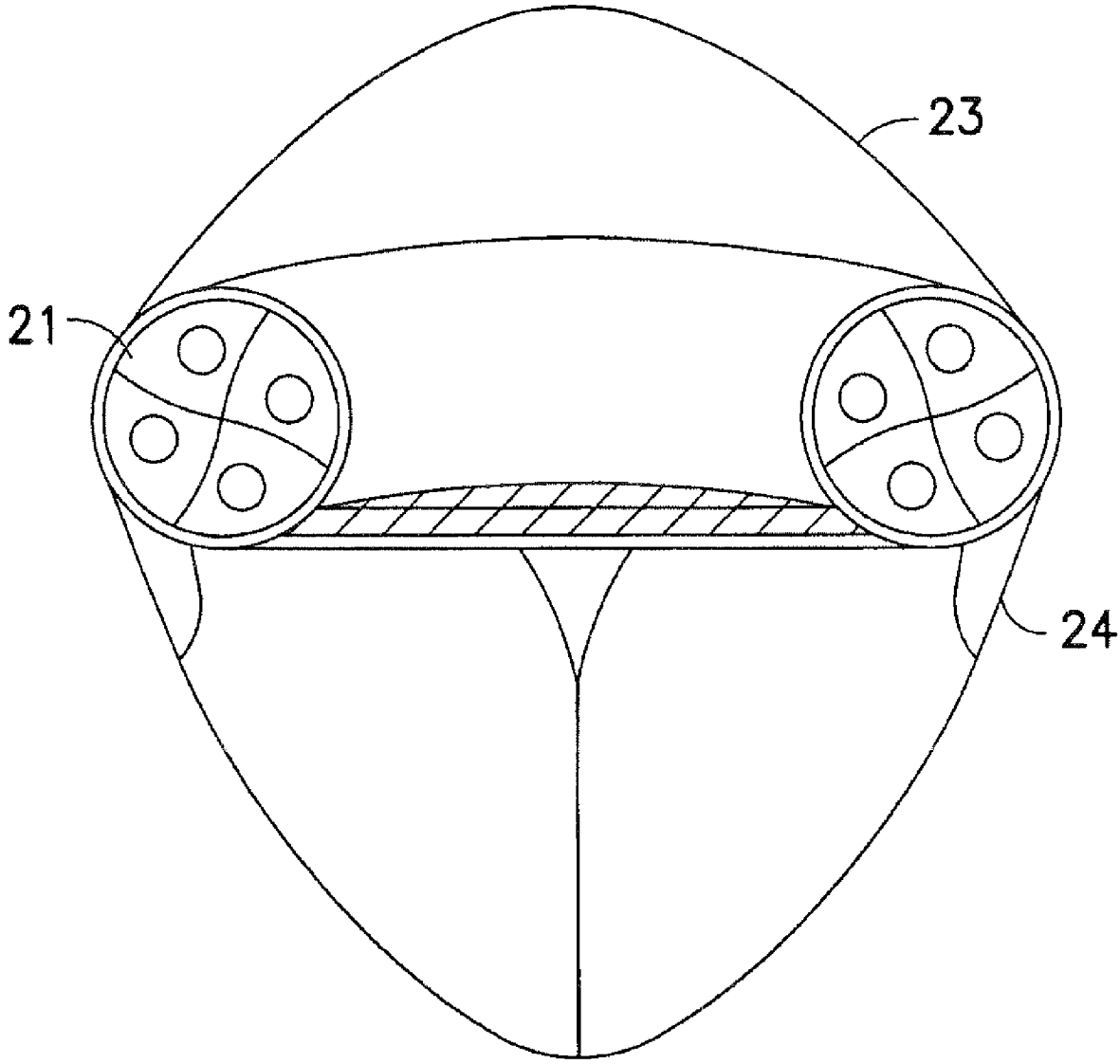
FIG. 4 is a cross sectional view illustrating a portable personal self-operating life tube of FIG. 2 according to a first embodiment of the present invention.

As shown in FIG. 4, the inner side of the tube body 21 is formed in a multiple-tier structure.

FIG. 4 is a view illustrating an inner structure of the tube body 21. As shown in FIG. 4, the inner side of the tube body 21 is divided into four independent sections with each section being filled with gas.

Even when part of the tube body is torn out or punched, the remaining parts can reliably filled with gas for thereby avoiding the problems found in the conventional art in which the tube cannot be used when only one part is holed. So, in an emergency situation, even when damages occur partially, an inherent function is performed, so it is possible to enhance the reliability of products.

When the portable personal self-operating life tube 10 according to the present invention is used, the user is not drowned in water like the conventional life tube or life jacket since the user rides on the boarding net 31 for thereby safely maintaining a body temperature. Since the cover 23 covers the user, a body temperature management and warming effect can be reliably performed until the user is rescued in rain for thereby enhancing survival possibility, and the user can use various items stored in the belt part 12, so the survival possibility can be further enhanced.

The detailed operations of the portable personal self-operating life tube 10 according to the present invention will be described with reference to FIG. 5.

Figure 5:
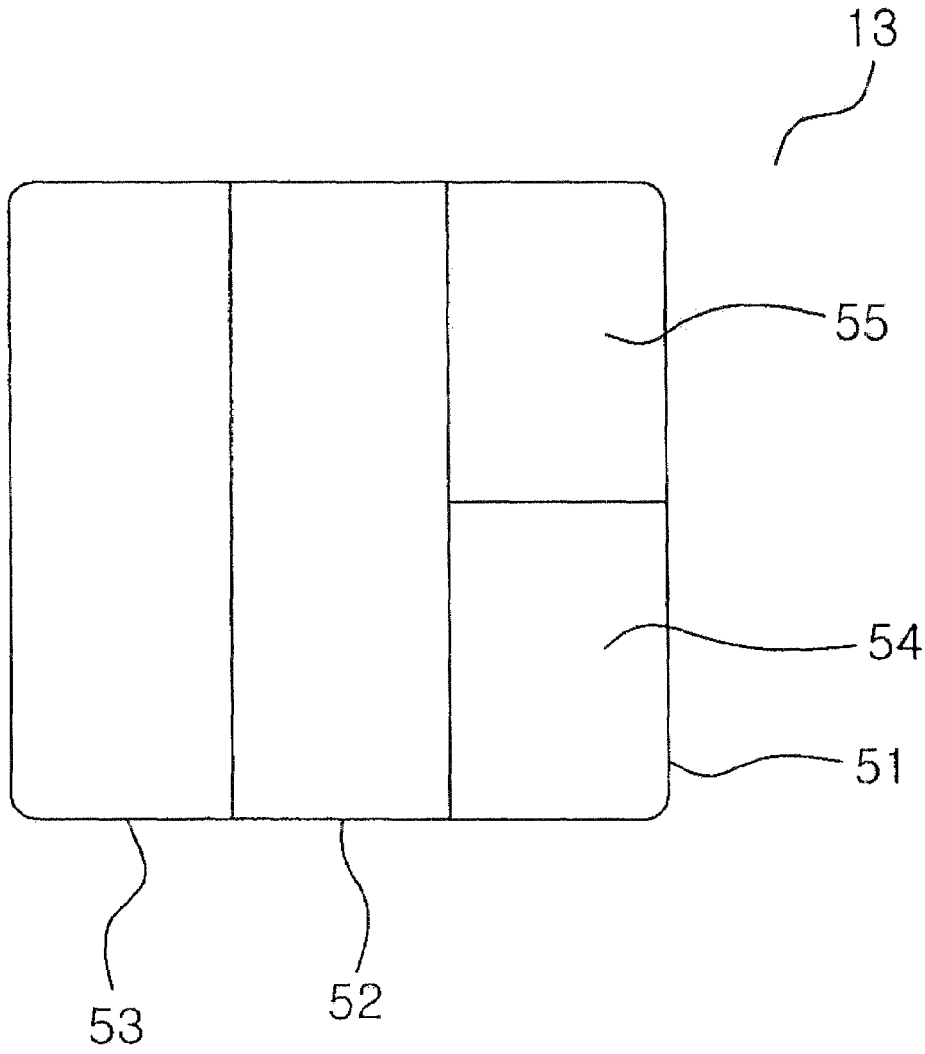
FIG. 5 is a view illustrating a structure of a tube part of a portable personal self-operating life tube of FIG. 1 according to a first embodiment of the present invention.

FIG. 5 is a view illustrating a structure of a tube part 13 of a portable personal self-operating life tube 10 according to the present invention.

As shown in FIG. 5, the tube part 13 comprises a tube storing room 53 for storing the tube 20, a gas generation module 52 for injecting gas into the tube 20, and a percussion cap 51 for operating the gas generation module 52.

The percussion cap 51 is formed of a seawater battery 54 for supplying power, and a circuit unit 55 which includes a timer and an amplifier for operating the percussion cap.

The belt part 12 and the tube part 13 are engaged using a water soluble polymer so they can be automatically separated when drowning in water.

For example, an engaging groove and an engaging protrusion are formed in the belt part 12 and the tube part 13, respectively, and one side of the engaging groove and protrusion is formed of a water soluble polymer, so as the water soluble polymer is melted, and the belt part 12 and the tube part 13 can be automatically separated.

Here, the separation time might be adjusted by controlling the kinds or amount of the water soluble polymer, and a groove might be formed in the engaged portion so water can be easily inputted into the water soluble polymer for a water passage. A spring might be installed in the engaging protrusion or the engaging groove, so even when the water soluble polymer is not fully melted, they be fast separated.

When the tube part 13 is separated, the power is supplied from the seawater battery 54 and is amplified by means of the circuit part 55. When a certain level voltage is obtained, the electric percussion cap installed in the percussion cap 51 is operated, and a detonator is ignited, and the gas is filled from the gas generation module 52 into the tube 20 through the connection pipe 27. So, the connection line 26 has a certain length long enough for obtaining a safety distance.

In more detail, the seawater battery 54 is designed to generate electricity by using silver chloride and aluminum alloy as the + and − poles, and by using seawater as electrolyte. When the tube 20 is substantially expanded, the remaining power is used for driving the LEDs 32.

When the tube of the present invention is not adapted in sea, the seawater battery and sodium chloride are provided together, and when water is inputted, sodium chloride is melted and has the same concentration as seawater, so the tube of the present invention might work even in fresh water.

As the seawater battery 54 is used, it is not needed to exchange the power or battery, so the present invention can be used in seawater as well as fresh water.

When the power is supplied from the seawater battery 54, the power is amplified and accumulated through an amplification circuit formed of a transistor and a capacitor installed in the circuit part 55, and when the voltage able to operating the electric percussion cap is reached, the power is supplied at the time set by the timer installed in the circuit part 55 for thereby detonating.

The electric percussion cap, for example, is formed as an electric line is arranged in a double structure, which can detonate by a voltage below 6V. A gas detonator filled in the interior of the module as being connected with the gas generation module 52 is exploded, so nitrogen gas is generated for thereby expanding the tube 20.

The gas generation module 52 is filled with the gas generation agent formed of sodium nitride, oxidized steel, nitric barium, silica, clay, etc. in the interior of the body formed of aluminum alloy. Here, an aluminum net shaped filter and a silica gel are disposed between the body and the gas generation agent, and the electric percussion cap is positioned in the interior of the gas generation agent, so nitric gas is generated by means of the detonation of the electric percussion cap, and the nitric gas is inputted into the tube 20 through the connection pipe 27.

So, the portable personal self-operating life tube 10 can be automatically expanded.

When a user, who wears a portable personal self-operating life tube 10 according to the present invention is drowned in water, the water soluble polymer is melted, and the bent part 12 and the tube part 13 are separated, and the seawater batter 54 in the tube part 13 operates, and the power is supplied to the circuit unit 55, and the electric percussion cap installed in the percussion cap 51 detonates the gas generation agent in the gas generation module 52 depending on the operation of the circuit unit 55 for thereby generating nitric gas, so the tube 20 is expanded.

At this time, as the water soluble polymer is melted, the belt part 12 and the tube part 13 are separated preferably in five seconds in consideration with the safety of the user, and the time that the tube 20 is expanded is about 15 seconds. So, the tube is substantially expanded in about 20 seconds after the user is drowned.

The user, who wears a portable personal self-operating life tube of the present invention, can survive the danger of life since the tube is automatically expanded even when the user loses consciousness due to accident.

The portable personal self-operating life tube 10 according to a first embodiment of the present invention was described, but the above disclosed contents are not limited thereto.

Figure 6:
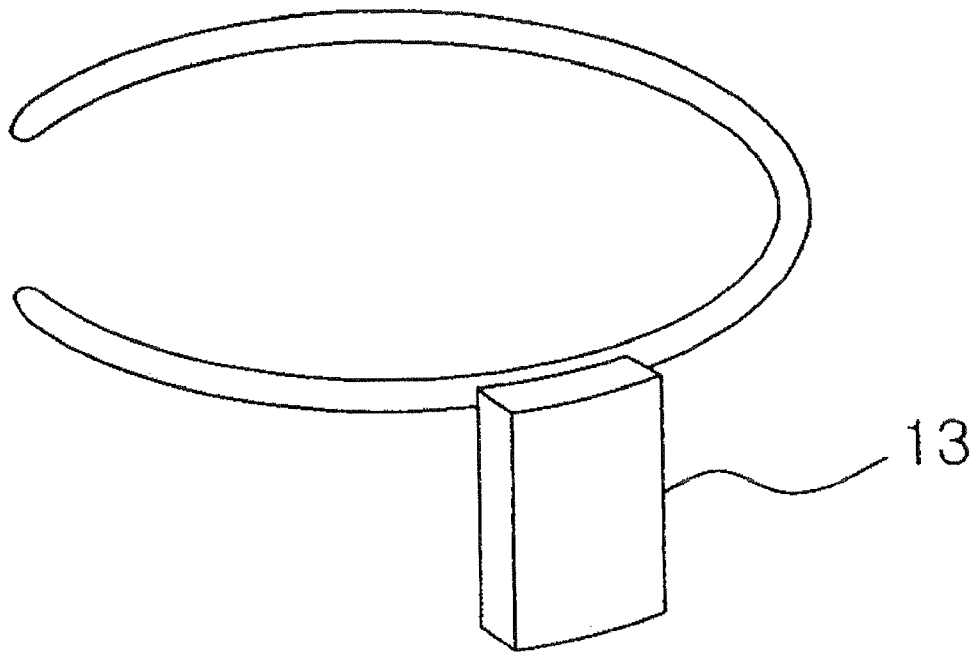
FIG. 6 is a view illustrating a portable personal self-operating life tube according to a second embodiment of the present invention.

In the first embodiment of the present invention, the portable personal self-operating life tube 10 formed of the belt part 12 and the tube part 13 was described. The above-disclosed construction is not limited. As shown in FIG. 6, the belt part 12 might be formed in a band or a ring type for tying on an arm or a leg instead of using a belt for tying on a waist.

Figure 7:
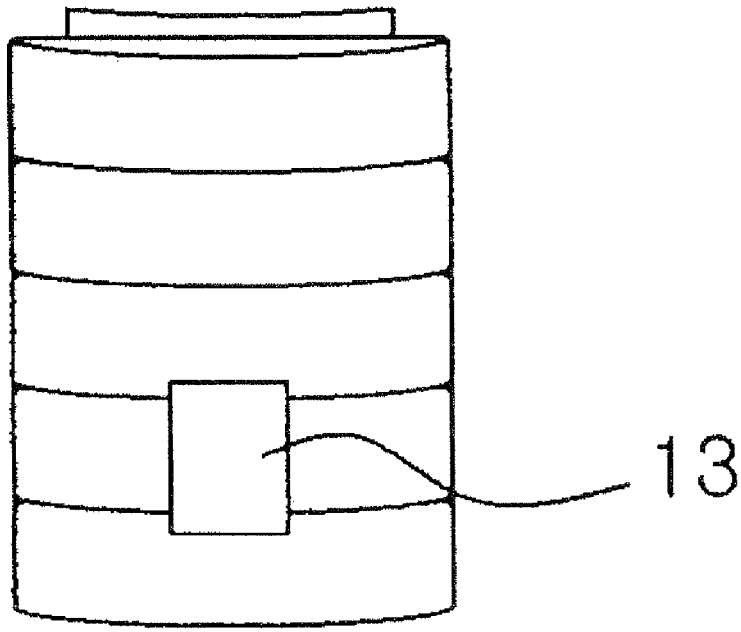
FIG. 7 is a view illustrating a portable personal self-operating life tube according to a third embodiment of the present invention.

In the first embodiment of the present invention, the portable personal self-operating life tube 10 formed of the belt part 12 and the tube part 13 was described, but the above-disclosed contents are not limited thereto. As shown in FIG. 7, the tube part 13 might be attached to a conventional life jacket or a user's clothes, so it might be applied for various purposes.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A portable personal self-operating life tube, comprising:

a belt part having an adhesion tape, so its both ends are connected with other; and a tube part which is installed in the belt part, wherein said tube part includes:

a tube storing room for storing a tube formed of a waterproof clothes;

a gas generation module for injecting gas so that the tube is expanded; and a percussion cap for operating the gas generation module, and wherein said tube includes:

a tube body injected with gas for supporting the tube on the surface of the water;

a boarding net formed in a net structure, so a user can ride on a center portion of the tube body;

a tube lower part formed in a convex shape in a lower side of the tube body and having a drainage part at its both sides for passing water; and a cover for covering the whole portions of the tube body at both ends of the tube body, and wherein said percussion cap includes:

a detonation agent;

an electric percussion cap for detonating the detonation agent;

a circuit part which includes a timer and an amplifier for operating the electric percussion cap; and a seawater battery for supplying electric power to the electric percussion cap and the circuit unit; and wherein said belt part and said tube part are engaged by means of a water soluble polymer.

2. The tube of claim 1, wherein said tube body further includes a plurality of LEDs installed along its outer surface, and the inner section of the tube body to be injected with gas is divided into four independent sections.

3. The tube of claim 1, wherein said seawater battery further includes a sodium chloride.

4. The tube of claim 1, wherein said belt part further includes an emergency item such as a rain coat, am emergency food, a light emitting rod, an emergency knife or tool or something.

5. The tube of claim 1, wherein said belt part is formed in a band shape or a ring shape for being tied to an arm or a leg.

6. The tube of claim 1, wherein said tube part is attached to a life jacket or a clothes instead the belt part.

* * * * *